US007704100B1

(12) United States Patent
McClellan et al.

(10) Patent No.: US 7,704,100 B1
(45) Date of Patent: Apr. 27, 2010

(54) ELECTRICAL CONNECTOR ASSEMBLY WITH ANTI-STUBBING FEATURE

(75) Inventors: Justin Shane McClellan, Camp Hill, PA (US); Daniel Robert Ringler, Elizabethville, PA (US); Jason M'Cheyne Reisinger, Carlisle, PA (US); Jason Edward Vrenna, Angola, NY (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/351,335

(22) Filed: Jan. 9, 2009

(51) Int. Cl.
*H01R 24/00* (2006.01)

(52) U.S. Cl. ..... 439/637; 439/636

(58) Field of Classification Search ..... 439/249, 439/636–637, 885
See application file for complete search history.

(56) References Cited

U.S. PATENT DOCUMENTS 4,166,667 A * 9/1979 Griffin ..... 439/637
4,349,237 A * 9/1982 Cobaugh et al. ..... 439/377
5,024,609 A * 6/1991 Piorunneck ..... 439/637
5,041,005 A 8/1991 McHugh
5,567,171 A 10/1996 Mizuguchi
5,609,502 A * 3/1997 Thumma ..... 439/747
5,830,017 A * 11/1998 Owsley et al. ..... 439/637
6,135,781 A 10/2000 Pope et al.
7,210,955 B2 5/2007 Ringler et al.

* cited by examiner

*Primary Examiner*—Michael C Zarroli

(57) ABSTRACT

An electrical connector assembly includes a housing having a slot configured to receive at least a portion of an electronic module therein. The housing includes an anti-stubbing shoulder. An electrical contact is held by the housing. The electrical contact includes a mating contact portion and an anti-stubbing contact portion. At least a portion of the mating contact portion extends within the slot for engagement with the electronic module. Engagement between the anti-stubbing portion of the electrical contact and the anti-stubbing shoulder of the housing moves at least a portion of the mating contact portion of the electrical contact generally away from the slot of the housing.

18 Claims, 9 Drawing Sheets

ELECTRICAL CONNECTOR ASSEMBLY WITH ANTI-STUBBING FEATURE

BACKGROUND OF THE INVENTION

The subject matter described and/or illustrated herein relates generally to electrical connectors, and, more particularly, to electrical connectors for electronic modules.

Computers and servers may use numerous types of electronic modules, such as processor and memory modules (e.g. Dynamic Random Access Memory (DRAM), Synchronous Dynamic Random Access Memory (SDRAM), Extended Data Out Random Access Memory (EDO RAM), and the like). The memory modules are produced in a number of formats such as, for example, Single In-line Memory Modules (SIMM's), the newer Dual In-line Memory Modules (DIMM's), Small Outline DIMM's (SODIMM's), and Fully Buffered DIMM's.

Typically, the electronic modules are installed in a socket mounted on a circuit board. Each electronic module has a mating edge portion that provides an interface generally between two opposite rows of contacts held by a housing of the socket. The socket housings sometimes include a slot that receives the mating edge portion of the electronic module therein. The contacts held by the socket housing include mating contact portions that extend into the slot for engagement with the mating edge portion of the electronic module. The contacts thereby establish an electrical connection between the electronic module and the circuit board. However, engagement between the mating edge portion of the electronic module and the mating contact portions may damage the contacts, such as, but not limited to, if the mating contact portions of the contacts extend too far into the slot. For example, the contacts may bend and/or fracture along the mating contact portion and/or at an intersection between the mating contact portion and an intermediate portion thereof. Sometimes, the mating contact portion of the contacts may be crushed between the mating edge portion of the electronic module and a portion of the socket housing. Damage to the contacts caused by engagement with the electronic module is sometimes referred to as "stubbing" of the contacts.

There is a need for an electrical connector for electronic modules having contacts that are less likely to be damaged via engagement with a mating edge portion of the electronic module.

BRIEF DESCRIPTION OF THE INVENTION

In one embodiment, an electrical connector assembly includes a housing having a slot configured to receive at least a portion of an electronic module therein. The housing includes an anti-stubbing shoulder. An electrical contact is held by the housing. The electrical contact includes a mating contact portion and an anti-stubbing contact portion. At least a portion of the mating contact portion extends within the slot for engagement with the electronic module. Engagement between the anti-stubbing portion of the electrical contact and the anti-stubbing shoulder of the housing moves at least a portion of the mating contact portion of the electrical contact generally away from the slot of the housing.

Optionally, the anti-stubbing portion of the electrical contact includes an extension, wherein engagement between the extension and the anti-stubbing shoulder of the housing moves the mating contact portion generally away from the slot of the housing. The anti-stubbing shoulder optionally includes a surface defining an anti-stubbing path of the anti-stubbing portion of the electrical contact, wherein movement of the anti-stubbing portion along the surface moves the mating contact portion generally away from the slot of the housing. Optionally, engagement between the anti-stubbing portion of the electrical contact and the anti-stubbing shoulder of the housing moves at least a portion of the mating contact portion of the electrical contact generally away from at least a portion of the electronic module when the electronic module is at least partially received within the slot of the housing.

The anti-stubbing portion of the electrical contact optionally includes a pair of opposite extensions. Optionally, the electrical contact includes an end portion that includes the anti-stubbing portion of the electrical contact. The anti-stubbing shoulder optionally includes a surface defining an anti-stubbing path of the anti-stubbing portion of the electrical contact, wherein the anti-stubbing path includes a curve. The anti-stubbing shoulder of the housing optionally includes a pair of opposing anti-stubbing shoulders. Optionally, engagement between the anti-stubbing portion of the electrical contact and the anti-stubbing shoulder of the housing moves the mating contact portion against a bias of at least a portion of the mating contact portion of the electrical contact. The mating contact portion of the electrical contact optionally includes the anti-stubbing portion of the electrical contact.

In another embodiment, a socket connector assembly is provided for connecting an electronic module to a circuit board. The socket connector assembly includes a housing having a mounting face configured for mounting on the circuit board and a slot configured to receive a mating edge of the electronic module. The housing includes an anti-stubbing shoulder. An electrical contact is held by the housing. The electrical contact includes a mating contact portion and an anti-stubbing contact portion. At least a portion of the mating contact portion extends within the slot for engagement with the electronic module. Engagement between the anti-stubbing portion of the electrical contact and the anti-stubbing shoulder of the housing moves at least a portion of the mating contact portion of the electrical contact generally away from the slot of the housing.

DETAILED DESCRIPTION OF THE INVENTION

Figure 1:
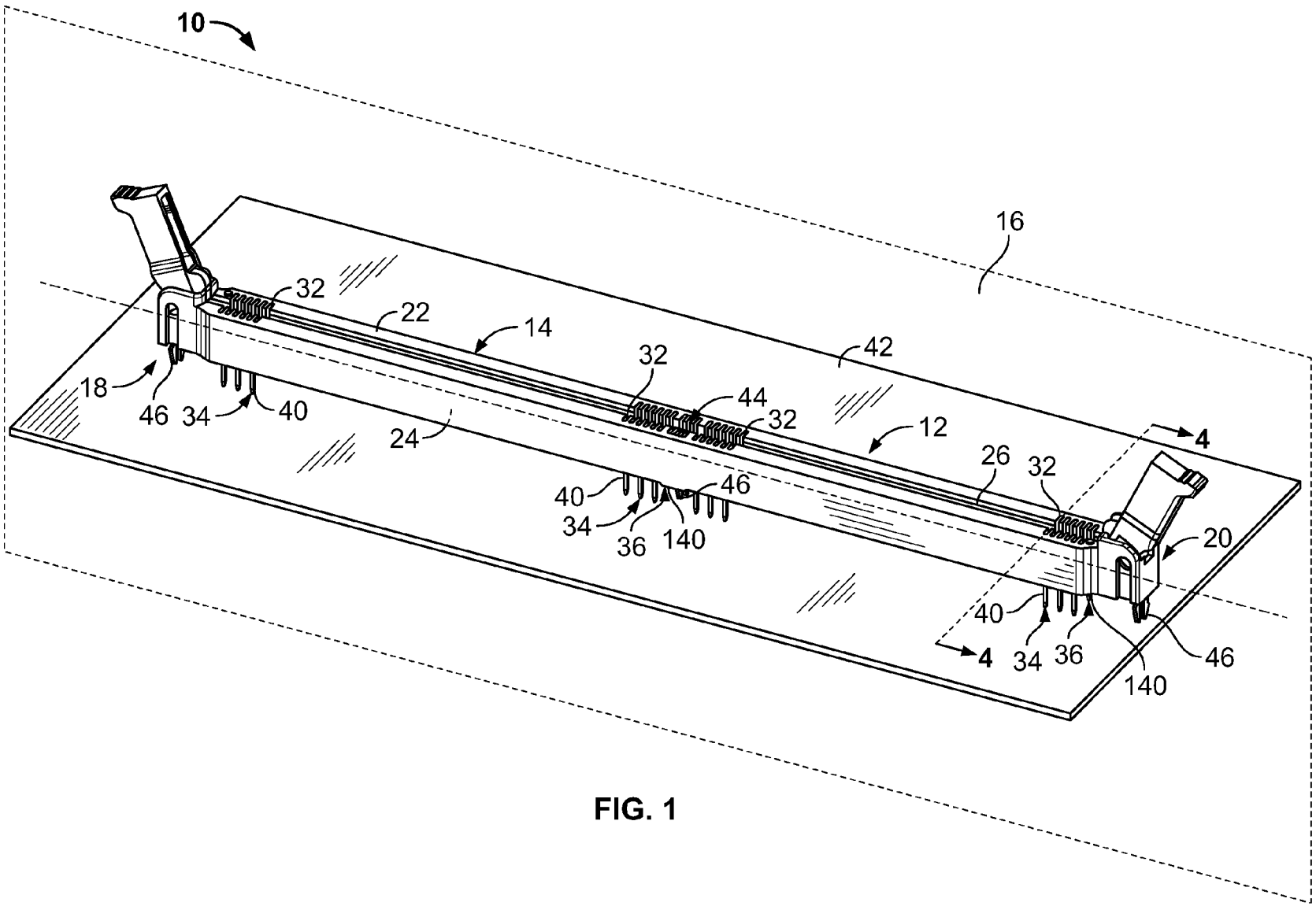
FIG. 1 is a partially exploded perspective view of an exemplary embodiment of a socket connector assembly and an exemplary circuit board.
Figure 2:
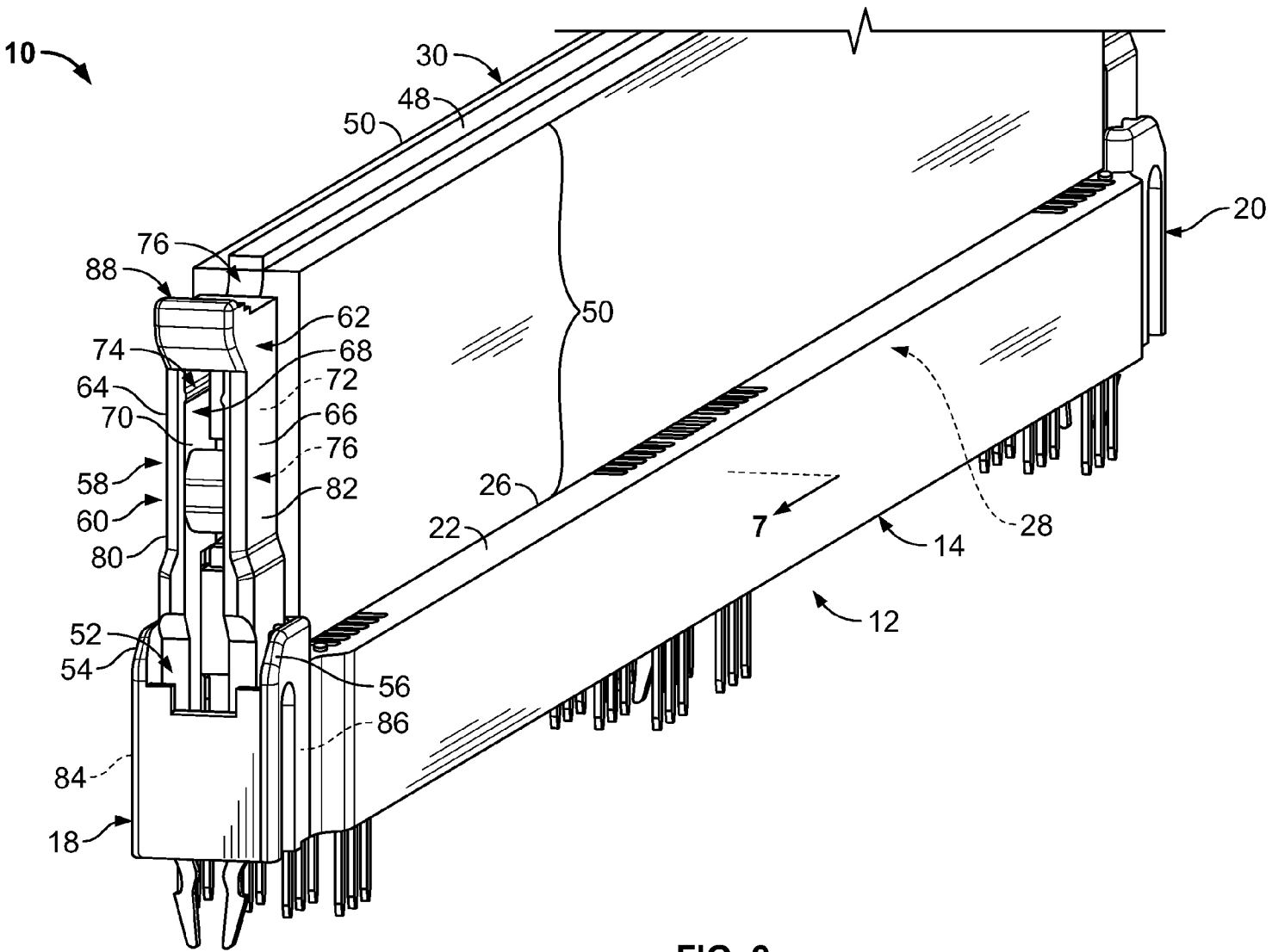
FIG. 2 is a perspective view of the socket connector assembly shown in FIG. 1 with an exemplary electronic module installed thereon.
Figure 5:
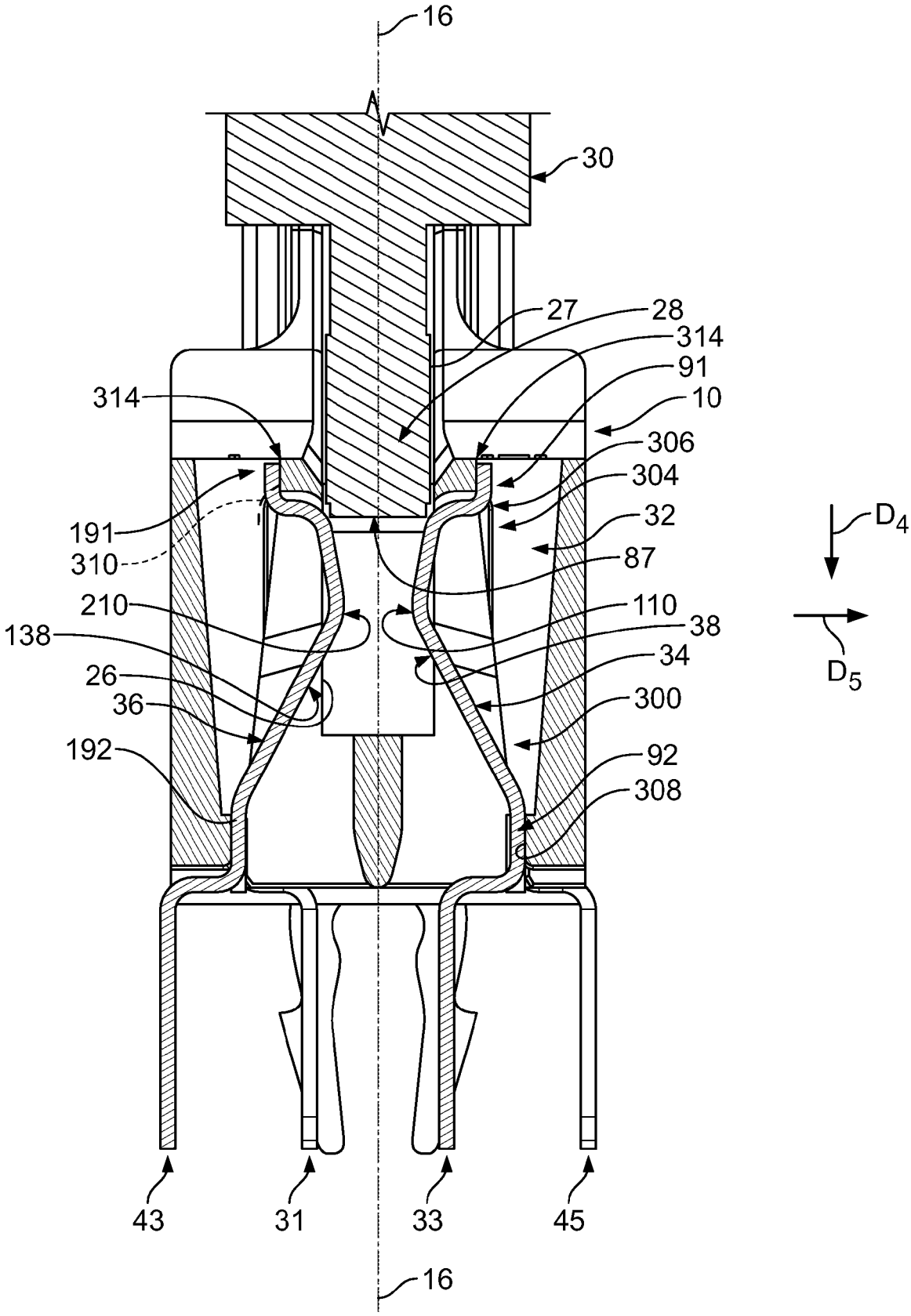
FIG. 5 is a cross-sectional view of the socket connector assembly shown in FIGS. 1 and 2 illustrating the electronic module partially received within an exemplary embodiment of a slot of the socket connector assembly.
Figure 6:
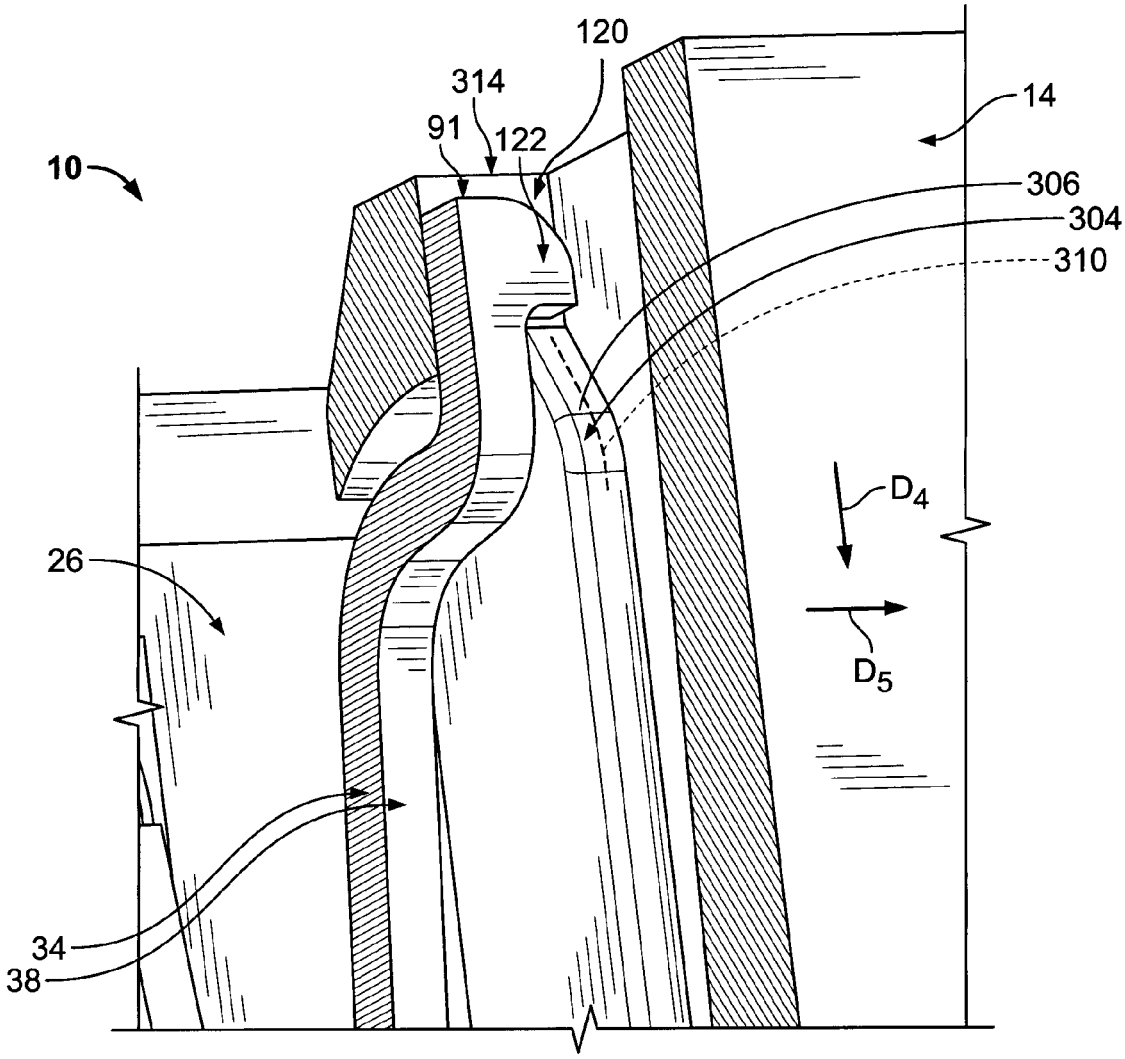
FIG. 6 is an enlarged perspective view of a portion of the socket connector assembly shown in FIGS. 1, 2, and 5.
Figure 7:
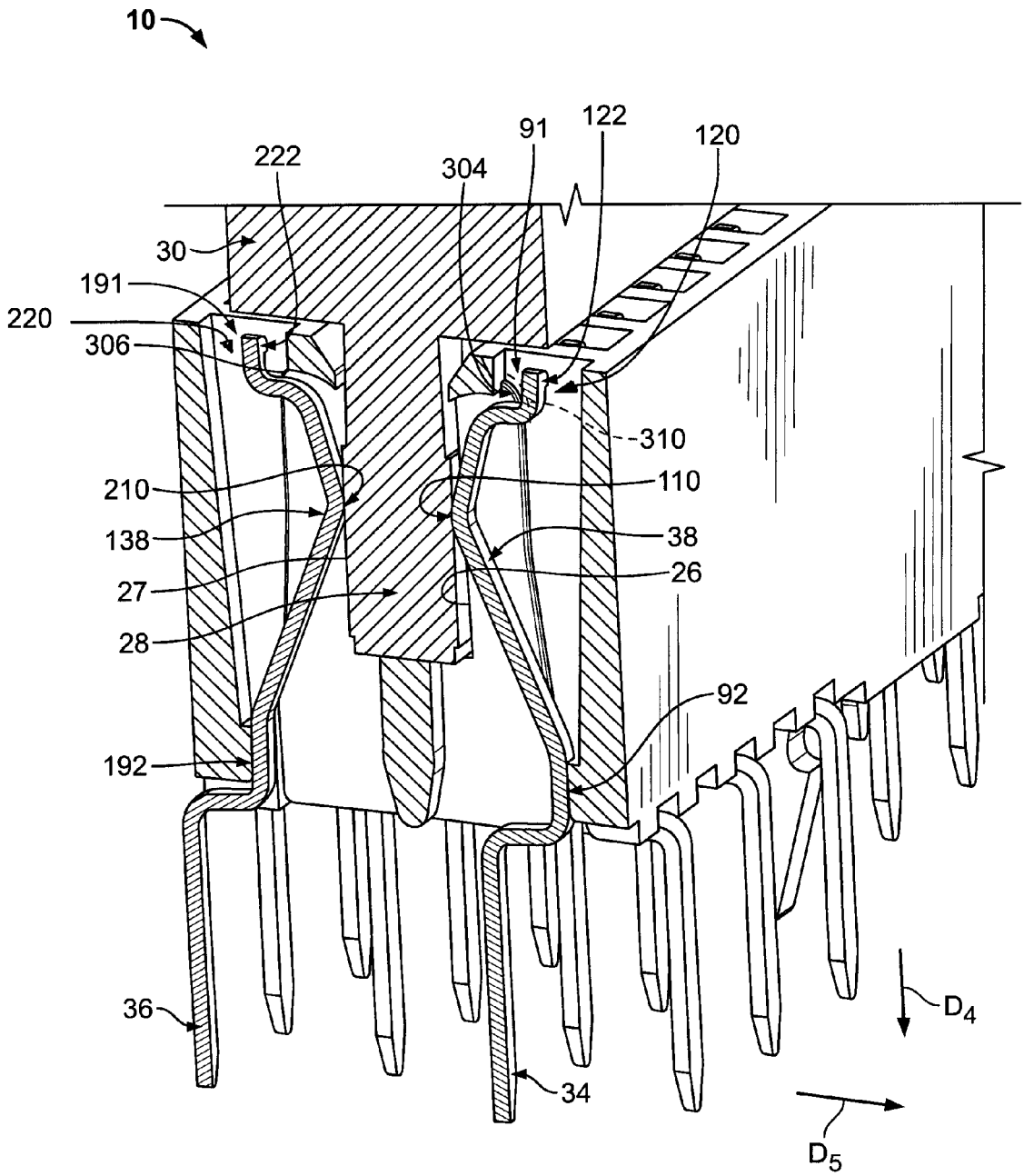
FIG. 7 is a perspective view illustrating a cross section of the socket connector assembly shown in FIGS. 1, 2, and 5 taken along line 7-7 of FIG. 2.

FIG. 1 is a partially exploded perspective view of an exemplary embodiment of a socket connector assembly 10 and an exemplary circuit board 42. The socket connector assembly 10 includes a housing 12 having a dielectric body 14 that extends along a central longitudinal plane 16 between opposite end portions 18 and 20. The body 14 has a mating face 22 and a mounting face 24. The body 14 includes a slot 26 that is configured to receive a mating edge portion 28 (FIGS. 2, 5, and 7) of an electronic module 30 (FIGS. 2, 5, and 7). The housing body 14 includes a plurality of openings 32 that each communicate with the slot 26 and extend through the housing body 14 from the mating face 22 to the mounting face 24. As will be described below, each opening 32 holds a portion of a corresponding inner or outer electrical contact 34 and 36, respectively, therein. Each inner and outer electrical contact 34 and 36, respectively, includes a respective mating contact portion 38 and 138 (FIGS. 3 and 5-7) and a respective mounting contact portion 40 and 140. The mating contact portions 38 and 138 extend into the slot 26 to electrically engage contact pads 27 (FIGS. 5 and 7) on the electronic module 30 when the electronic module 30 is installed in the socket connector assembly 10. The mounting contact portions 40 and 140 extend from the mounting face 24 of the housing body 14 and are configured to electrically connect the socket connector assembly 10 to the circuit board 42 to enable the connection of the electronic module 30 to the circuit board 42. The inner and outer electrical contacts 34 and 36, respectively, are alternated within adjacent openings 32 to form inner rows 31 and 33 (FIG. 5) of the mounting contact portions 40 and outer rows 43 and 45 (FIG. 5) of the mounting contact portions 140. Specifically, the mounting contact portions 40 of the inner electrical contacts 34 are arranged in a pair of opposite inner rows 31 and 33 that are offset on opposite sides of a central longitudinal plane 16 of the housing body 14. Similarly, the mounting contact portions 140 of the outer electrical contacts 36 are arranged in a pair of opposite outer rows 43 and 45 that are offset on opposite sides of the central longitudinal plane 16 of the housing body 14 by a greater amount than the inner rows 31 and 33. (The offsets of the mounting contact portions 40 and 140 are best seen in FIG. 5.)

Optionally, a key 44 is provided at an off-center position in the slot 26 for reception within a notch (not shown) in the electronic module 30 to assure that the electronic module 30 is properly aligned with respect to the connector assembly 10. One or more board locks 46 are optionally provided to mechanically attach the socket connector assembly 10 to the circuit board 42.

FIG. 2 is a perspective view of the socket connector assembly 10 with an exemplary electronic module 30 installed thereon. The electronic module 30 includes a planar substrate 48 that has the mating edge portion 28 and a plurality of electrical traces (not shown), each of which terminates at a corresponding one of the contact pads 27 (FIGS. 5 and 7) on the mating edge portion 28. When the electronic module 30 is installed on the housing body 14 as shown in FIG. 2, each of the contact pads 27 on the mating edge portion 28 of the electronic module 30 electrically engages the mating contact portion 38 or 138 (FIGS. 3 and 5-7) of a corresponding one of the electrical contacts 34 or 36. The substrate 48 includes exemplary surface mounted components generally represented at 50.

The housing end portions 18 and 20 are substantially identical and therefore only the housing end portion 18 is described in detail. The housing end portion 18 includes a cavity 52 between opposed towers 54 and 56 that extend outwardly at the mating face 22 of the housing body 14. An extractor 58 is received in the cavity 52. The extractor 58 is pivotably connected to the housing end portion 18 for retaining the electronic module 30 on the housing body 14 and for extracting the electronic module 30 from the housing body 14. Specifically, the extractor 58 extends outwardly between the towers 54 and 56 and is pivotable between an open position (FIG. 1) for receiving the electronic module 30 within the slot 26 and a closed position (FIG. 2) for retaining the electronic module 30.

The extractor 58 includes a pair of opposite side portions 60 and 62 that each engages the electronic module 30. Specifically, each of the side portions 60 and 62 includes a side wall 64 and 66, respectively. The side walls 64 and 66 are spaced apart from one another such that an extractor slot 68 is defined therebetween. The extractor slot 68 is in communication with the slot 26 in the housing body 14. The extractor slot 68 receives an edge portion 76 of the substrate 48 of the electronic module 30. Opposite interior surfaces 70 and 72 of the side walls 64 and 66, respectively, include ribs 74 that engage the edge portion 76 of the substrate 48 of the electronic module 30 to stabilize the electronic module 30. Optionally, a beveled forward edge (not shown) on the ribs 74 provides guidance for facilitating entry of the edge portion 76 of the electronic module 30 into the extractor slot 68. The extractor 58 may include a latch element (not shown) that engages a notch (not shown) in the edge portion 76 of the substrate 48 of the electronic module 30 to facilitate retaining the electronic module 30 on the housing body 14. Opposite outer surfaces 80 and 82 of the side walls 64 and 66, respectively, may include a projection (not shown) that communicates with a retention receptacle (not shown) on inner surfaces 84 and 86 of the towers 54 and 56, respectively, to facilitate holding the extractor 58 in the closed position. A foot (not shown) of the extractor 58 engages a lower edge 87 (FIG. 5) of the mating edge portion 28 of the electronic module 30 to lift the electronic module 30 upward when the extractor 58 is opened to assist in the extraction of the electronic module 30 from the housing body 14. The extractor 58 optionally includes a thumb pad 88 for moving the extractor 58 between the open and closed positions.

Figure 3:
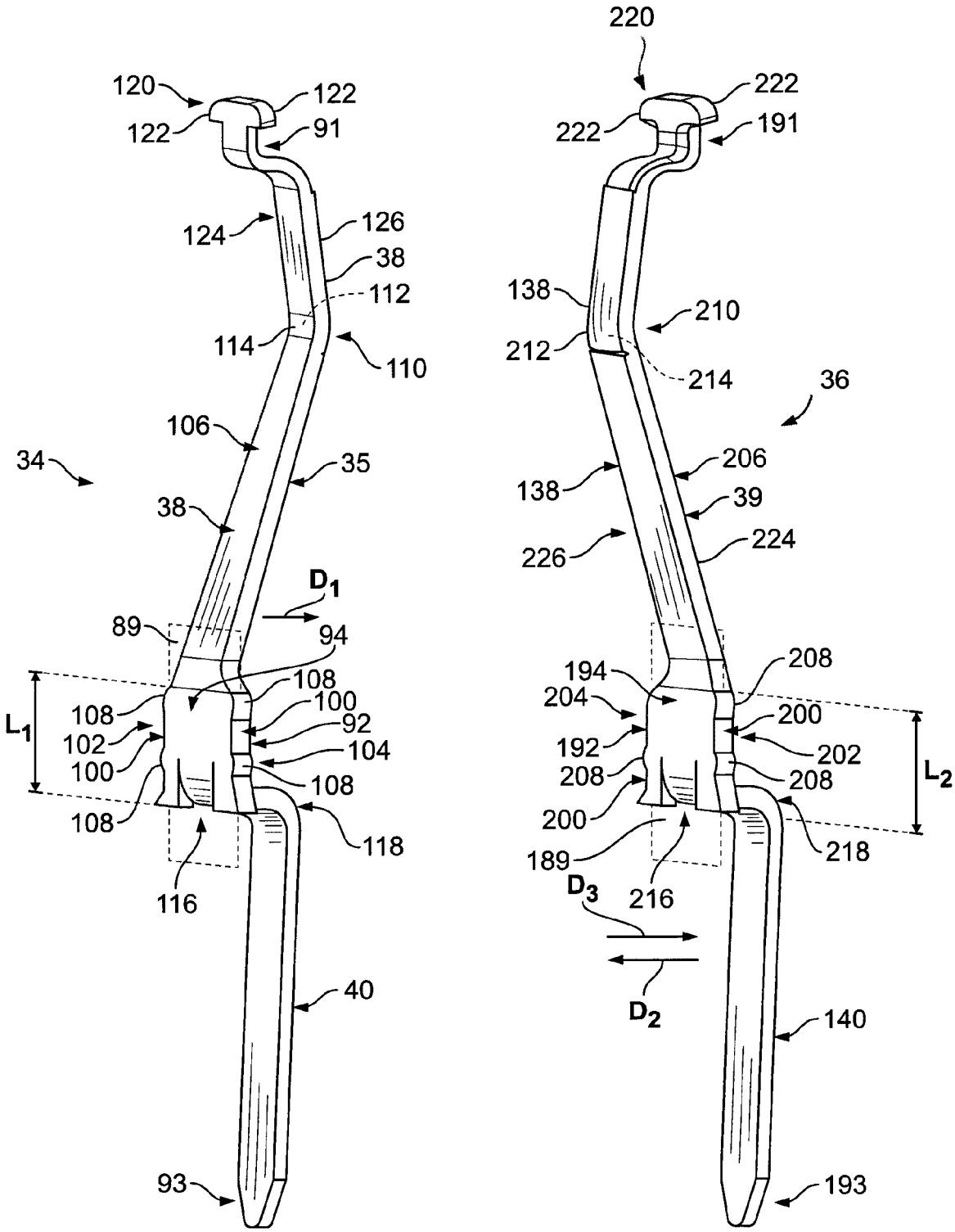
FIG. 3 is a perspective view of an exemplary embodiment of an inner electrical contact and an exemplary embodiment of an outer electrical contact of the socket connector assembly shown in FIGS. 1 and 2.

FIG. 3 is a perspective view of an exemplary embodiment of an inner electrical contact 34 and an exemplary embodiment of an outer electrical contact 36 of the socket connector assembly 10 (FIGS. 1, 2, and 5-7). Each inner electrical contact 34 includes a body 35 having the mating contact portion 38, the mounting contact portion 40, and an intermediate portion 92 extending between the mating contact portion 38 and the mounting contact portion 40. Similarly, each outer electrical contact 36 includes a body 39 having the mating contact portion 138, the mounting contact portion 140, and an intermediate portion 192 extending between the mating contact portion 138 and the mounting contact portion 140. In the exemplary embodiment, the mating contact portions 38 and 138 each include a respective end portion 91 and 191 of the respective inner and outer electrical contacts 34 and 36, and the mounting contact portions 40 and 140 each include a respective opposite end portion 93 and 193 of the inner and outer electrical contacts 34 and 36, respectively. The mating and mounting contact portions 38 and 40, respectively, of the inner electrical contact 34 are offset from a plane 89 of the intermediate portion 92 in generally the same direction $D_1$. In contrast, the mating and mounting contact portions 138 and 140, respectively, of the outer electrical contact 36 are offset from a plane 189 of the intermediate portion 192 in generally respective opposite directions $D_2$ and $D_3$.

The intermediate portion 92 of the inner electrical contact 34 includes a stem 94 extending a length $L_1$. In the exemplary embodiment, a pair of extensions 100 extend outwardly at opposite side portions 102 and 104 of the stem 94. Similarly, the intermediate portion 192 of the outer electrical contact 36 includes a stem 194 extending a length $L_2$. A pair of extensions 200 extend outwardly at opposite side portions 202 and 204 of the stem 194. As will be described below, the extensions 100 and 200 are configured to engage the housing body 14 (FIGS. 1, 2, and 4-7) to facilitate retaining the inner and outer electrical contacts 34 and 36, respectively, in position within the corresponding opening 32 (FIGS. 1, 4, 5, and 7) of the housing body 14 using an interference-fit arrangement. Optionally, each of the extensions 100 and 200 includes one or more respective projections 108 and 208 that engage the housing body 14.

Although one pair of two of each of the extensions 100 and the extensions 200 are shown, the respective intermediate portions 92 and 192 may each include any number of pairs of the respective extensions 100 and 200, and any number of the respective extensions 100 and 200 overall, that enable the extension(s) 100 and 200 to function as described and/or illustrated herein. In some embodiments, some or all of the extensions 100 and/or 200 are not paired with another respective extension 100 and 200 on the opposite side portion 102 or 104 and 202 or 204, respectively. Moreover, each extension 100 and 200 may extend from either of the side portions 102 or 104 and 202 or 204, respectively, and may be located at any portion of the respective length $L_1$ and $L_2$ of the respective stem 94 and 194 (whether or not the extension 100 and/or 200 is paired with, and/or has the same location along the respective length $L_1$ and $L_2$ as, another extension 100 and 200, respectively, on the respective opposite side portion 102 or 104 and 202 or 204).

The mating contact portion 38 of the inner electrical contact 34 includes a stem 106 that extends from the stem 94 of the intermediate portion 92 to the end portion 91 of the inner electrical contact 34. The stem 106 includes a bend 110 having a radially outer surface 112 and a radially inner surface 114. The contact pads 27 (FIGS. 5 and 7) of the electronic module 30 (FIGS. 2, 5, and 7) engage the surface 112 of the stem 106 when the electronic module 30 is installed on the housing body 14. Similarly, the mating contact portion 138 of the outer electrical contact 36 includes a stem 206 that extends from the stem 194 of the intermediate portion 192 to the end portion 191 of the outer electrical contact 36. The stem 206 includes a bend 210 having a radially outer surface 212 and a radially inner surface 214. The contact pads 27 of the electronic module 30 engage the surface 212 of the stem 206 when the electronic module 30 is installed on the housing body 14. In the exemplary embodiments, the mating contact portions 38 and 138 are springs that have a natural resting position shown in FIG. 3. The mating contact portions 38 and 138 deflect against bias from the natural resting position when engaged by the electronic module 30, as will be described below.

The mating contact portion 38 of the inner electrical contact 34 includes an anti-stubbing portion 120. In the exemplary embodiment, the anti-stubbing portion 120 includes a pair of extensions 122 that extend outwardly at opposite side portions 124 and 126 of the stem 106. Similarly, the mating contact portion 138 of the outer electrical contact 36 includes an anti-stubbing portion 220. In the exemplary embodiment, the anti-stubbing portion 220 includes a pair of extensions 222 that extend outwardly at opposite side portions 224 and 226 of the stem 206. As will be described below, the anti-stubbing portions 120 and 220 of the inner and outer electrical contacts 34 and 36, respectively, are configured to engage the housing body 14 to facilitate moving at least a portion of the respective mating contact portion 38 and 138 generally away from the slot 26 (FIGS. 1, 2, 5, and 7) when engaged by the electronic module 30.

In addition or alternative to the extensions 122 and/or 222, each of the anti-stubbing portions 120 and 220, respectively, may include any other structure, means, configuration, and/or the like that enables the anti-stubbing portions 120 and/or 220 to function as described and/or illustrated herein. Although one pair of two of each of the extensions 122 and the extensions 222 are shown, the respective anti-stubbing portions 120 and 220 may each include any number of pairs of the respective extensions 122 and 222, and any number of the respective extensions 122 and 222 overall, that enable the extension(s) 122 and/or 222 to function as described and/or illustrated herein. In some embodiments, some or all of the extensions 122 and/or 222 are not paired with another respective extension 122 and 222 on the opposite side portion 124 or 126 and 224 or 226, respectively. Moreover, each extension 122 and 222 may extend from either of the side portions 124 or 126 and 224 or 226, respectively (whether or not the extension 122 and/or 222 is paired with, and/or has the same location along the length of the respective stem 106 and 206 as, another extension 122 and 222, respectively, on the respective opposite side portion 124 or 126 and 224 or 226). In the exemplary embodiment, each of the extensions 122 and 222 is located at the respective end portion 91 and 191. However, each extension 122 and 222 may be located at any portion along a length of the respective stem 106 and 206 (whether or not the extension 122 and/or 222 is paired with, and/or has the same location along the length of the respective stem 106 and 206 as, another extension 122 and 222, respectively, on the respective opposite side portion 124 or 126 and 224 or 226).

The mounting contact portion 40 of the inner electrical contact 34 extends from the intermediate portion 92 at an optional bend 116. The mounting contact portion 40 extends from the bend 116 to the end portion 93 of the inner electrical contact 34. The mounting contact portion 40 includes an optional bend 118. In the exemplary embodiment, the bends 116 and 118 are each approximately 90°. Alternatively, the bend 116 and/or 118 may have any other angle than approximately 90°. Similar to the inner electrical contact 34, the mounting contact portion 140 of the outer electrical contact 36 extends from the intermediate portion 192 at an optional bend 216. The mounting contact portion 140 extends from the bend 216 to the end portion 193 of the outer electrical contact 36. The mounting contact portion 140 includes an optional bend 218. In the exemplary embodiment, the bends 216 and 218 are each approximately 90°. Alternatively, the bend 216 and/or 218 may have any other angle than approximately 90°.

The size, shape, and location on the electrical contacts 34 and 36 of each of the respective portions 38, 40, 92, 138, 140, and 192, as well as the overall size and geometry of the electrical contacts 34 and 36 overall, is not limited to the embodiments described and illustrated herein, but rather may be any size, shape, location, geometry, and/or the like that enables the electrical contacts 34 and 36 to function as described and/or illustrated herein. In the some embodiments, the exemplary geometry of the electrical contacts 34 and 36 described and/or illustrated herein may result in approximately equal electrical path lengths between some or all of the mounting contact portions 40 and/or 140.

Figure 4:
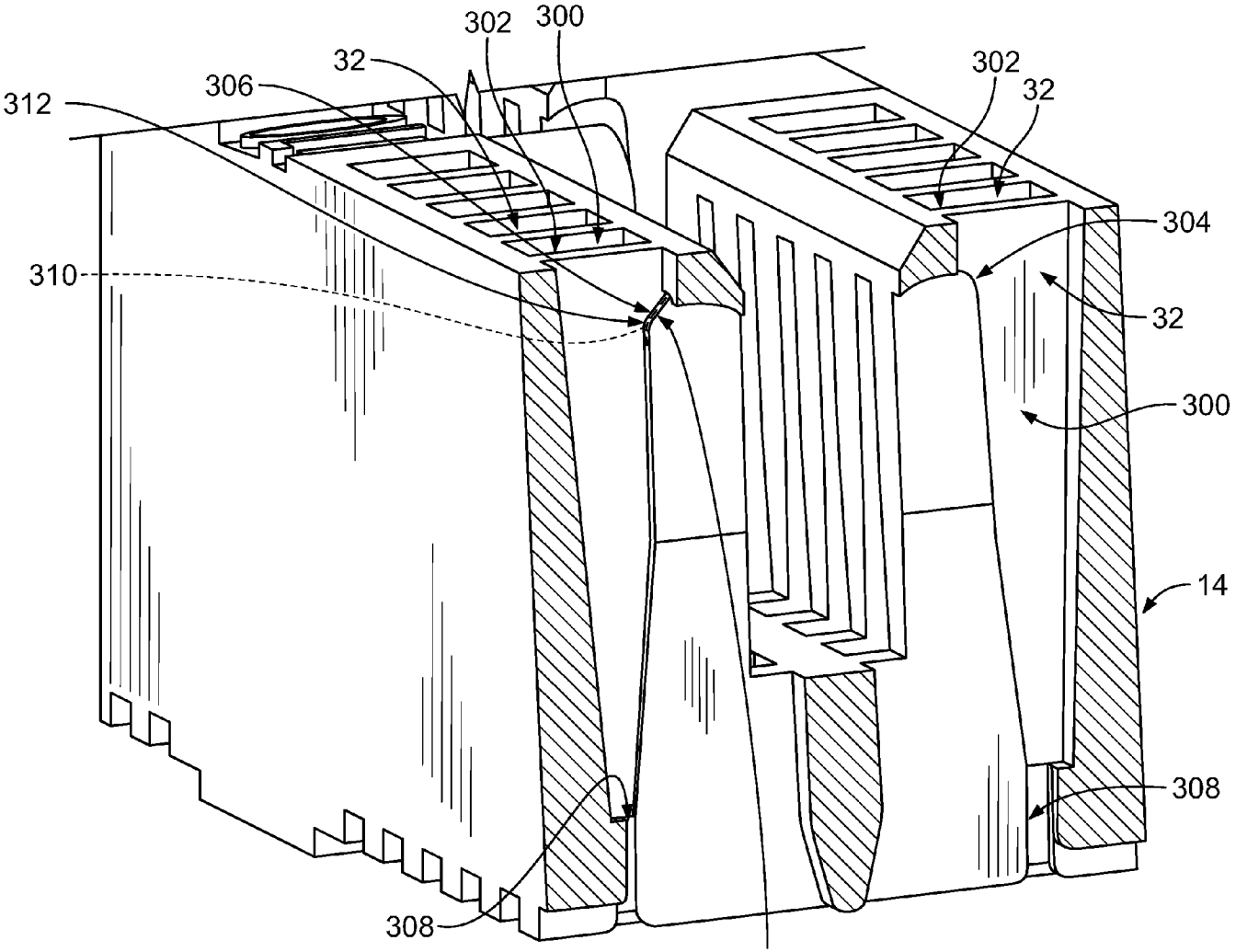
FIG. 4 is a perspective view illustrating a cross section of an exemplary embodiment of a housing of the socket connector assembly shown in FIGS. 1 and 2 taken along line 4-4 of FIG. 1.

FIG. 4 is a perspective view illustrating a cross section of the housing body 14 of the socket connector assembly 10 (FIGS. 1, 2, and 5-7) taken along line 4-4 of FIG. 1. The housing body 14 is illustrated in FIG. 4 with the inner and outer electrical contacts 34 and 36 (FIGS. 1, 3, and 5-7), respectively, removed therefrom. Each of the openings 32 within the housing body 14 includes a pair of opposite side walls 300 and 302. Each opening 32 includes a portion 308 that is configured to receive a corresponding one of the intermediate portions 92 or 192 (FIG. 3). A corresponding one of the pair of extensions 100 or 200 (FIG. 3) engages the side walls 300 and 302 to facilitate retaining the corresponding electrical contact 34 or 36 in position within the opening 32 using an interference-fit arrangement. Optionally, the projections 108 or 208 (FIG. 3) of the corresponding extension 100 or 200 engage the side walls 300 and 302 to facilitate retaining the corresponding electrical contact 34 or 36 using an interference-fit arrangement.

Although the exemplary embodiment includes two, each side wall 300 and 302 of each opening 32 may include any number of the portions 308 for cooperating with any number of extensions 100 or 200 on the corresponding intermediate portion 92 or 192. Each portion 308 may include any suitable shape, and may have any suitable location on the corresponding side wall 300 or 302, that enables the portion 308 to cooperate with the corresponding extension 100 or 200 to facilitate retaining the corresponding electrical contact 34 or 36 as described and illustrated herein.

In the exemplary embodiment, each of the side walls 300 and 302 includes an anti-stubbing shoulder 304 formed therein. As will be described below, the anti-stubbing shoulders 304 are each configured to engage a corresponding one of the extensions 122 or 222 (FIGS. 3, 6, and 7) to facilitate moving at least a portion of the mating contact portion 38 and 138 of the respective electrical contact 34 and 36 generally away from the slot 26 (FIGS. 1, 2, 5, and 7) when engaged by the electronic module 30 (FIGS. 2, 5, and 7). Each anti-stubbing shoulder 304 includes a surface 306 that defines an anti-stubbing path 310 of a corresponding one of the anti-stubbing portions 120 or 220 of the inner and outer electrical contacts 34 and 36, respectively. As can be seen in FIG. 4, in the exemplary embodiment, the surface 306 includes a curve 312. However, in addition or alternative to the curve, the surface 306 of each anti-stubbing shoulder 304 may include any shape(s), and may have any location on the corresponding side wall 300 or 302, that enables the anti-stubbing shoulder 304 to function as described and/or illustrated herein. Moreover, the anti-stubbing path 310 provided by each anti-stubbing shoulder 304 may be any path that extends in any direction(s) that enables the anti-stubbing shoulder 304 to function as described and/or illustrated herein.

Although each side wall 300 and 302 includes a single anti-stubbing shoulder 304 such that each opening 32 includes two opposing anti-stubbing shoulders 304, each side wall 300 and 302 may include any number of anti-stubbing shoulders 304 for each cooperating with any number of extensions 122 or 222. Moreover, each opening 32 may include any number of anti-stubbing shoulders 304 for each cooperating with any number of extensions 122 or 222.

FIG. 5 is a cross-sectional view of the socket connector assembly 10 illustrating the electronic module 30 partially received within the slot 26. The housing body 14 is illustrated in FIG. 5 with the inner and outer electrical contacts 34 and 36, respectively, positioned within the corresponding openings 32. When the electrical contacts 34 and 36 are received within the corresponding openings 32, the intermediate portions 92 and 192 are received within the corresponding portion 308 and the extensions 100 or 200 (FIG. 3) engage the side walls 300 and 302 (side wall 302 is shown in FIG. 4) to facilitate retaining the electrical contact 34 or 36 in position within the opening 32 using an interference-fit arrangement. Optionally, the projections 108 and 208 (FIG. 3) of the extensions 100 and 200 engage the side walls 300 and 302 to facilitate retaining the corresponding electrical contact 34 or 36 using an interference-fit arrangement. As can be seen in FIG. 5, in the exemplary embodiment, a portion of each of the mating contact portions 38 and 138 extends within the slot 26.

Before the mating edge portion 28 of the electronic module 30 is fully received in the slot 26, the mating contact portions 38 and 138 of the inner and outer electrical contacts 34 and 36, respectively, extend within the housing body 14 in the natural resting position thereof, as shown in FIG. 5. Moreover, the end portions 91 and 191 of the respective electrical contacts 34 and 36 are each engaged with a corresponding shoulder 314 of the housing body 14. FIG. 6 is an enlarged perspective view of a portion of the socket connector assembly 10. As can be seen in FIG. 6, when the mating contact portion 38 of the inner electrical contact 34 extends within the housing body 14 in the natural resting position as shown in FIG. 5, the extensions 122 are optionally not engaged with the corresponding anti-stubbing shoulders 304. Although not shown, when the mating contact portion 138 of the outer electrical contact 34 extends within the housing body 14 in the natural resting position as shown in FIG. 5, the extensions 222 are optionally not engaged with the corresponding anti-stubbing shoulders 304. The end portion 91 of the inner electrical contact 34 can also be seen in FIG. 6 as engaged with the corresponding shoulder 314 of the housing body 14.

FIG. 7 is a perspective view illustrating a cross section of the socket connector assembly 10 taken along line 7-7 of FIG. 2. FIG. 7 illustrates the mating edge portion 28 of the electronic module 30 fully received within the slot 26. When the electronic module 30 is fully received within the slot 26 as shown in FIG. 7, the contact pads 27 of the electronic module 30 are engaged with the mating portions 38 and 138 of the inner and outer electrical contacts 34 and 36, respectively. The electronic module 30 is thereby electrically connected to the inner and outer electrical contacts 34 and 36, respectively. The mating contact portions 38 and 138 are deflected, against bias, from the natural resting position shown in FIGS. 3, 5, and 6 to a deflected position shown in FIG. 7. Specifically, engagement with the mating edge portion 28 of the electronic module 30 as the electronic module 30 is inserted into the slot 26 deflects the mating contact portions 38 and 138. Any portion(s) of each of the electrical contacts 34 and 36 may bend to deflect the mating contact portions 38 and 138 from the natural resting positions to the deflected positions. In the exemplary embodiment, the electrical contacts 34 and 36 each bend at an interface between the respective intermediate portion 92 and 192 and the respective mating contact portion 38 and 138.

Referring now to FIGS. 5-7, during insertion of the mating edge portion 28 (not shown in FIG. 6) of the electronic module 30 (not shown in FIG. 6) into the slot 26, engagement between the mating edge portion 28 and the mating contact portions 38 and/or 138 (the mating contact portion 138 is not shown in FIG. 6) may sometimes push at least a portion of the mating contact portions 38 and/or 138 generally in the direction $D_4$. For example, engagement between the mating edge portion 28 and the mating contact portions 38 and/or 138 may cause a portion of the mating contact portions 38 and/or 138 to bend such that the end portions 91 and/or 191 (the end portion 191 is not shown in FIG. 6) are pushed generally in the direction $D_4$. As the end portions 91 and/or 191 move generally in the direction $D_4$, the extensions 122 and/or 222 (the extension 122 and 222 are not visible in FIG. 5; the extension 222 is not shown in FIG. 6) engage the surface 306 of the corresponding anti-stubbing shoulder 304. As the end portions 91 and/or 191 move further in the general direction $D_4$, the extensions 122 and/or 222 move along the surface 306 of the corresponding anti-stubbing shoulder 304, and thereby move along the corresponding anti-stubbing path 310. Movement of the extensions 122 and/or 222 along the corresponding anti-stubbing path 310 causes at least a portion of the respective mating contact portion 38 and/or 138 to move generally away from the slot 26. For example, movement of the extensions 122 and/or 222 along the corresponding anti-stubbing path 310 may cause the bends 110 and/or 210 (not shown in FIG. 6) of the respective mating contact portions 38 and 138 to move generally in the direction $D_5$. In some embodiments, movement of the portion(s) of the mating contact portions 38 and/or 138 generally away from the slot 26 is against a bias of the mating contact portions 38 and/or 138 to the natural resting position.

Movement of the portion(s) of the mating contact portions 38 and/or 138 generally away from the slot 26 may reduce an amount of force exerted on the mating contact portions 38 and/or 138 by the mating edge portion 28 of the electronic module. In addition or alternative, movement of the portion (s) of the mating contact portions 38 and/or 138 generally away from the slot 26 may cause the mating contact portions 38 and/or 138 to disengage from the mating edge portion 28. In addition or alternative, movement of the portion(s) of the mating contact portions 38 and/or 138 generally away from the slot 26 may enable the mating edge portion 28 to be fully received into the slot 26 without damaging (at least further if any damage has already been sustained) the electrical contacts 34 and/or 36. For example, movement of the portion(s) of the mating contact portions 38 and/or 138 generally away from the slot 26 may enable the mating edge portion 28 of the electronic module 30 to be fully received within the slot 26 without crushing any portion(s) of the mating contact portions 38 and/or 138 between the mating edge portion 28 and the housing body 14. Moreover, and for example, movement of the portion(s) of the mating contact portions 38 and/or 138 generally away from the slot 26 may enable the mating edge portion 28 of the electronic module 30 to be fully received within the slot 26 without fracturing, and/or bending more than is desired, any portion(s) of the electrical contacts 34 and/or 36

Although the bends 110 and 210 are described herein as moving generally away from the slot 26, any portion(s) of the mating contact portions 38 and/or 138 may move generally away from the slot 26 via engagement of the extensions 122 and/or 222 with corresponding anti-stubbing shoulders 304. Moreover, movement generally away from the slot 26 is not limited to the general direction $D_5$. Rather, the portion(s) of the mating contact portions 38 and/or 138 may move in any direction(s) that is generally away from the slot 26. Further, movement of the end portions 91 and/or 191 via engagement of the respective mating contact portions 38 and/or 138 with the electronic module 30 is not limited to the general direction $D_4$. Rather, the end portions 91 and/or 191 may move in any direction(s) that causes the respective extensions 122 and/or 222 to engage the corresponding surface 306 and thereby move along the corresponding anti-stubbing path 310. Each anti-stubbing path 310 is also not limited to what is specifically described and/or illustrated herein. Rather, each anti-stubbing path 310 may be any path that extends in any direction(s) that moves the portion(s) of the mating contact portions 38 and/or 138 generally away from the slot 26.

In the exemplary embodiment of FIGS. 1-7, the mounting contact portions 40 and 140 of the electrical contacts 34 and 36, respectively, are configured as solder tails that electrically connect to the circuit board 42 using solder. However, the mounting contact portions 40 and 140 are not limited to being solder tails, but rather may have any suitable arrangement, configuration, structure, geometry, and/or the like that enables the mounting contact portions 40 and 140 to electrically connected to the circuit board 42 and/or another electrical component, such as, but not limited to, using a press-fit arrangement, a surface mount arrangement, and/or the like.

Figure 8:
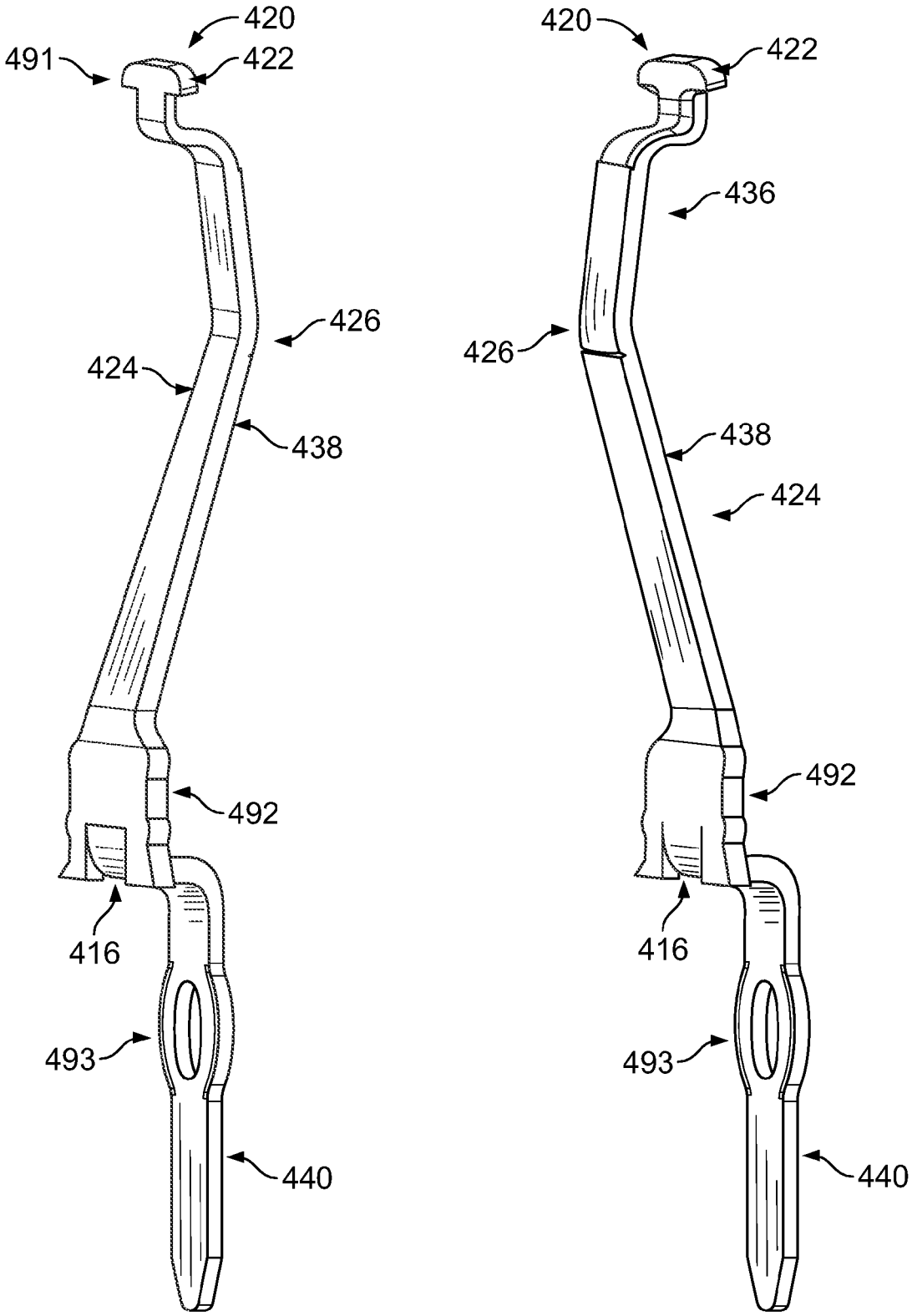
FIG. 8 is a perspective view of exemplary alternative embodiments of inner and outer electrical contacts.

For example, FIG. 8 is a perspective view of an exemplary alternative embodiment of inner and outer electrical contacts 434 and 436, respectively. Each of the electrical contacts 434 and 436 includes a mating contact portion 438, a mounting contact portion 440, and an intermediate portion 492 extending between the mating contact portion 438 and the mounting contact portion 440. The mounting contact portions 440 each extend from the corresponding intermediate portion 492 at a bend 416. In the exemplary embodiment, the mounting contact portions 440 each include an end portion 493 of the corresponding electrical contact 434 or 436. As can be seen in FIG. 8, each of the mounting contact portions 440 is configured to electrically connect to a circuit board or other electrical component using a press-fit arrangement.

The mating contact portions 438 of the inner and outer electrical contacts 434 and 436, respectively, include anti-stubbing portions 420. In the exemplary embodiment, the anti-stubbing portions 420 each includes a pair of extensions 422 that extend outwardly at opposite side portions 424 and 426 of the mating contact portion 438. The anti-stubbing portions 420 are each configured to engage the housing body 14 (FIGS. 1, 2, and 4-7) to facilitate moving at least a portion of the corresponding mating contact portion 438 generally away from the slot 26 (FIGS. 1, 2, 5, and 7) when the mating contact portion 438 is engaged by the electronic module 30 (FIGS. 2, 5, and 7).

In addition or alternative to the extensions 422, each of the anti-stubbing portions 420 may include any other structure, means, configuration, and/or the like that enables the anti-stubbing portions 420 to function as described and/or illustrated herein. Although one pair of two of each of the extensions 422 is shown, each anti-stubbing portion 420 may each include any number of pairs of the extensions 422, and any number of the extensions 422 overall, that enable the extension(s) 422 to function as described and/or illustrated herein. In some embodiments, some or all of the extensions 422 are not paired with another extension 422 on the opposite side portion 424 or 426. Moreover, each extension 422 may extend from either of the side portions 424 or 426 (whether or not the extension 422 is paired with, and/or has the same location along the length of the corresponding mating contact portion 438 as, another extension 422 on the opposite side portion 424 or 426). In the exemplary embodiment, each of the extensions 422 is located at an end portion 491 of the corresponding electrical contact 434 or 436. However, each extension 422 may be located at any portion along a length of the corresponding mating contact portion 438 (whether or not the extension 422 is paired with, and/or has the same location along the length of the corresponding mating contact portion 438 as, another extension 422 on the opposite side portion 424 or 426).

Figure 9:
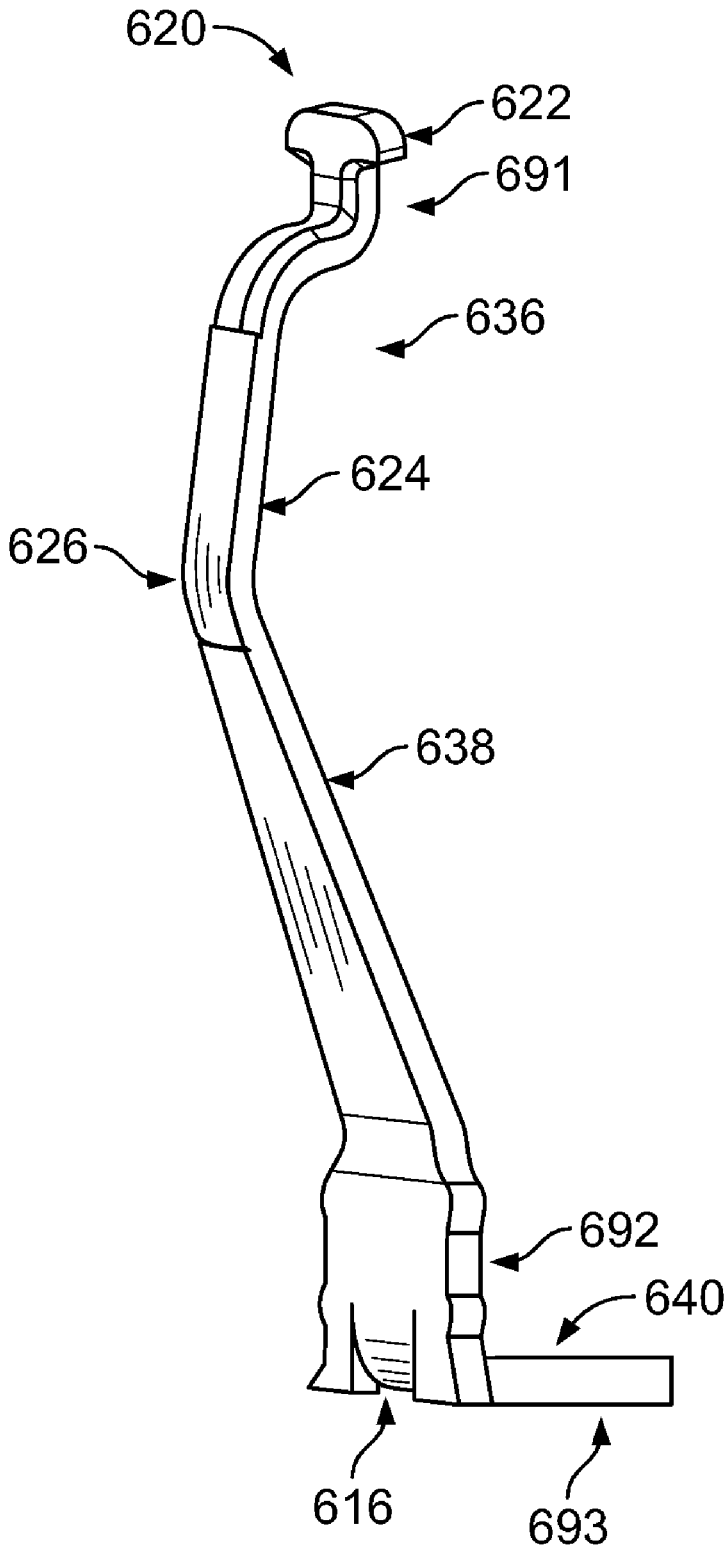
FIG. 9 is a perspective view of another exemplary alternative embodiment of an outer electrical contact.

Moreover, and for example, FIG. 9 is a perspective view of an exemplary alternative embodiment of an outer electrical contact 636. The electrical contact 636 includes a mating contact portion 638, a mounting contact portion 640, and an intermediate portion 692 extending between the mating contact portion 638 and the mounting contact portion 640. The mounting contact portion 640 extends from the intermediate portion 692 at a bend 616. As can be seen in FIG. 9, the mounting contact portion 640 is configured to electrically connect to a circuit board or other electrical component using a surface mount arrangement.

The mating contact portion 638 of the outer electrical contact 636 includes an anti-stubbing portion 620. In the exemplary embodiment, the anti-stubbing portion 620 includes a pair of extensions 622 that extend outwardly at opposite side portions 624 and 626 of the mating contact portion 638. The anti-stubbing portion 620 is configured to engage the housing body 14 (FIGS. 1, 2, and 4-7) to facilitate moving at least a portion of the mating contact portion 638 generally away from the slot 26 (FIGS. 1, 2, 5, and 7) when the mating contact portion 638 is engaged by the electronic module 30 (FIGS. 2, 5, and 7).

In addition or alternative to the extensions 622, the anti-stubbing portion 620 may include any other structure, means, configuration, and/or the like that enables the anti-stubbing portion 620 to function as described and/or illustrated herein. Although one pair of two extensions 622 is shown, the anti-stubbing portion 620 may include any number of pairs of the extensions 622, and any number of the extensions 622 overall, that enable the extension(s) 622 to function as described and/or illustrated herein. In some embodiments, some or all of the extensions 622 are not paired with another extension 622 on the opposite side portion 624 or 626. Moreover, each extension 622 may extend from either of the side portions 624 or 626 (whether or not the extension 622 is paired with, and/or has the same location along the length of the mating contact portion 638 as, another extension 622 on the opposite side portion 624 or 626). In the exemplary embodiment, each of the extensions 622 is located at an end portion 691 of the electrical contact 636. However, each extension 622 may be located at any portion along a length of the mating contact portion 638 (whether or not the extension 622 is paired with, and/or has the same location along the length of the mating contact portion 638 as, another extension 622 on the opposite side portion 624 or 626).

The embodiments described and/or illustrated herein may provide an electrical connector for electronic modules having contacts that are less likely to be damaged via engagement with a mating edge portion of the electronic module.

The connector embodiments described and/or illustrated are not limited to use with any exemplary type of electronic module described and/or illustrated herein, but rather may be used with any suitable type of electronic module, such as, but not limited to, processor modules and/or memory modules, such as, but not limited to, Dynamic Random Access Memory (DRAM), Synchronous Dynamic Random Access Memory (SDRAM), Extended Data Out Random Access Memory (EDO RAM), Single In-line Memory Modules (SIMM's), Dual In-line Memory Modules (DIMM's), Small Outline DIMM's (SODIMM's), Fully Buffered DIMM's, and/or the like. Although described and illustrated herein as a socket connector, the embodiments described and/or illustrated herein are not limited to socket connectors, but rather may be any suitable type of connector, such as, but not limited to, a plug connector and/or a surface connector.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector assembly comprising:

a housing comprising a slot configured to receive at least a portion of an electronic module therein, the housing comprising an anti-stubbing shoulder comprising a surface; and an electrical contact held by the housing, the electrical contact comprising a mating contact portion and an anti-stubbing contact portion, at least a portion of the mating contact portion extending within the slot for engagement with the electronic module, the surface of the anti-stubbing shoulder of the housing defining an anti-stubbing path of the anti-stubbing portion of the electrical contact, wherein engagement between the anti-stubbing portion of the electrical contact and the anti-stubbing shoulder of the housing moves the anti-stubbing portion along the surface such that at least a portion of the mating contact portion of the electrical contact moves generally away from the slot of the housing.

2. The electrical connector assembly according to claim 1, wherein the anti-stubbing portion of the electrical contact comprises an extension, engagement between the extension and the anti-stubbing shoulder of the housing moving the mating contact portion generally away from the slot of the housing.

3. The electrical connector assembly according to claim 1, wherein engagement between the anti-stubbing portion of the electrical contact and the anti-stubbing shoulder of the housing moves at least a portion of the mating contact portion of the electrical contact generally away from at least a portion of the electronic module when the electronic module is at least partially received within the slot of the housing.

4. The electrical connector assembly according to claim 1, wherein the anti-stubbing portion of the electrical contact comprises a pair of opposite extensions.

5. The electrical connector assembly according to claim 1, wherein the electrical contact comprises an end portion that comprises the anti-stubbing portion of the electrical contact.

6. The electrical connector assembly according to claim 1, wherein the anti-stubbing path comprising a curve.

7. The electrical connector assembly according to claim 1, wherein the anti-stubbing shoulder of the housing comprises a pair of opposing anti-stubbing shoulders.

8. The electrical connector assembly according to claim 1, wherein engagement between the anti-stubbing portion of the electrical contact and the anti-stubbing shoulder of the housing moves the mating contact portion against a bias of at least a portion of the mating contact portion of the electrical contact.

9. The electrical connector assembly according to claim 1, wherein the anti-stubbing path extends in a direction generally away from the slot.

10. A socket connector assembly for connecting an electronic module to a circuit board, said socket connector comprising:

a housing comprising a mounting face configured for mounting on the circuit board and a slot configured to receive a mating edge of the electronic module, the housing comprising an anti-stubbing shoulder comprising a surface; and an electrical contact held by the housing, the electrical contact comprising a mating contact portion and an anti-stubbing contact portion, at least a portion of the mating contact portion extending within the slot for engagement with the electronic module, the surface of the anti-stubbing shoulder of the housing defining an anti-stubbing path of the anti-stubbing portion of the electrical contact, wherein engagement between the anti-stubbing portion of the electrical contact and the anti-stubbing shoulder of the housing moves the anti-stubbing portion along the surface such that at least a portion of the mating contact portion of the electrical contact generally away from the slot of the housing.

11. The socket connector assembly according to claim 10, wherein the anti-stubbing portion of the electrical contact comprises an extension, engagement between the extension and the anti-stubbing shoulder of the housing moving the mating contact portion generally away from the slot of the housing.

12. The socket connector assembly according to claim 10, wherein engagement between the anti-stubbing portion of the electrical contact and the anti-stubbing shoulder of the housing moves at least a portion of the mating contact portion of the electrical contact generally away from at least a portion of the electronic module when the electronic module is at least partially received within the slot of the housing.

13. The socket connector assembly according to claim 10, wherein the anti-stubbing portion of the electrical contact comprises a pair of opposite extensions.

14. The socket connector assembly according to claim 10, wherein the electrical contact comprises an end portion that comprises the anti-stubbing portion of the electrical contact.

15. The socket connector assembly according to claim 10, wherein the anti-stubbing path comprising a curve.

16. The socket connector assembly according to claim 10, wherein the anti-stubbing path extends in a direction generally away from the slot.

17. The socket connector assembly according to claim 10, wherein engagement between the anti-stubbing portion of the electrical contact and the anti-stubbing shoulder of the housing moves the mating contact portion against a bias of at least a portion of the mating contact portion of the electrical contact.

18. The socket connector assembly according to claim 10, wherein the housing comprises an opening, the electrical contact being held at least partially within the opening, the anti-stubbing shoulder of the housing being defined within the opening.

* * * * *